US011490199B2

(12) United States Patent
Matsuura

(10) Patent No.: US 11,490,199 B2
(45) Date of Patent: Nov. 1, 2022

(54) SOUND RECORDING APPARATUS, SOUND SYSTEM, SOUND RECORDING METHOD, AND CARRIER MEANS

(71) Applicant: Ricoh Company, Ltd., Tokyo (JP)

(72) Inventor: Atsushi Matsuura, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/490,825

(22) PCT Filed: Mar. 14, 2018

(86) PCT No.: PCT/JP2018/009889

§ 371 (c)(1),
(2) Date: Sep. 3, 2019

(87) PCT Pub. No.: WO2018/168902

PCT Pub. Date: Sep. 20, 2018

(65) Prior Publication Data

US 2020/0015007 A1 Jan. 9, 2020

(30) Foreign Application Priority Data

Mar. 14, 2017 (JP) ..... JP2017-048769
Feb. 23, 2018 (JP) ..... JP2018-030769

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01); *H04S 2400/15* (2013.01); *H04S 2420/11* (2013.01)

(58) Field of Classification Search
CPC ..... H04R 3/005; H04R 3/406; H04R 1/406; H04S 7/302; H04S 2400/15; H04S 2420/11
See application file for complete search history.

(56) References Cited

U.S. PATENT DOCUMENTS

2009/0316913 A1* 12/2009 McGrath ..... H04S 3/02 381/20
2010/0223552 A1* 9/2010 Metcalf ..... H04S 3/008 715/716

(Continued)

FOREIGN PATENT DOCUMENTS

CN 105898185 A 8/2016
JP 2015-167408 9/2015

(Continued)

OTHER PUBLICATIONS

International Search Report and Written Opinion dated Jun. 1, 2018 in PCT/JP2018/009889 filed on Mar. 14, 2018.

(Continued)

*Primary Examiner* — Ping Lee
(74) *Attorney, Agent, or Firm* — Xsensus LLP

(57) ABSTRACT

An apparatus, system, and method, each of which: acquires sound data generated from a plurality of sound signals collected at a plurality of microphones; acquires, from one or more sensors, a result of detecting a position of the sound recording apparatus at a time point during a time period when the plurality of sound signals is collected; and stores, in a memory, position data indicating the position of the sound recording apparatus detected at the time point, and sound data generated based on a plurality of sound signals collected at the microphones at the time point at which the position was detected, in association with each other.

20 Claims, 10 Drawing Sheets

(56) References Cited

U.S. PATENT DOCUMENTS

| | | | | |
|---|---|---|---|---|
| 2012/0162362 | A1 | 6/2012 | Garden et al. | |
| 2013/0218570 | A1 | 8/2013 | Imoto et al. | |
| 2014/0006471 | A1 | 3/2014 | Ikeda | |
| 2014/0079225 | A1* | 3/2014 | Jarske | G06F 3/167 381/56 |
| 2016/0073024 | A1 | 3/2016 | Yamamoto | |
| 2016/0227340 | A1 | 8/2016 | Peters | |
| 2016/0234438 | A1 | 8/2016 | Satoh | |
| 2017/0201825 | A1* | 7/2017 | Whyte | H04M 3/567 |
| 2017/0324931 | A1* | 11/2017 | Sun | H04N 7/15 |

FOREIGN PATENT DOCUMENTS

| | | | |
|---|---|---|---|
| JP | 2015-220595 | | 12/2015 |
| JP | 5846549 | B1 | 12/2015 |
| JP | 5843033 | B1 | 1/2016 |
| JP | 2016-042629 | | 3/2016 |
| JP | 2016-149733 | | 8/2016 |
| JP | 2016-163181 | A | 9/2016 |
| WO | 2016/093063 | A1 | 6/2016 |

OTHER PUBLICATIONS

Office Action dated Aug. 11, 2021 in Chinese Patent Application No. 201880017543.0, 8 pages.

Office Action dated Apr. 12, 2022, for corresponding Japanese Patent Application No. 2018-030769, 3 pp.

Office Action dated Jan. 11, 2022 in Japanese Patent Application No. 2018-030769, 4 pages.

* cited by examiner

SOUND RECORDING APPARATUS, SOUND SYSTEM, SOUND RECORDING METHOD, AND CARRIER MEANS

TECHNICAL FIELD

The present disclosure relates to a sound recording apparatus, a sound system, a sound recording method, and carrier means such as a recording medium.

BACKGROUND ART

For example, Ambisonics and wave field synthesis (WFS) are known in the related art as stereophonic sound techniques for reproducing an omnidirectional sound field. Ambisonics and WFS are techniques attempting to reproduce a highly accurate sound field in accordance with sound theory. For example, in Ambisonics, predetermined signal processing is performed on sound recorded using a plurality of microphones to reproduce the directivity of the sound at a position where the sound is listened to.

In these sound field reproduction methods, sound pickup conditions such as an arrangement of microphones typically need to be prepared highly accurately. For example, in Ambisonics, microphones called Ambisonics microphones need to be placed highly accurately in terms of arrangements and directions.

PTL 1 is known in relation to sound techniques. PTL 1 discloses a moving image distribution system for distributing a spherical moving image in real time. The moving image distribution system acquires stereophonic sound in synchronization with image capturing performed by a camera, distributes the spherical moving image and the stereophonic sound by using a distribution server, and reproduces sound data in accordance with a display range viewed by a user. However, PTL 1 fails to overcome an issue regarding unnaturalness in reproduced sound.

CITATION LIST

Patent Literature

PTL 1: Japanese Patent Registration No. 5777185

SUMMARY OF INVENTION

Technical Problem

In view of the above, the inventor of the present invention has found that there is a need for a system capable of reproducing sound without unnaturalness.

Solution to Problem

Example embodiments of the present invention include a sound recording apparatus including a controller to: acquire sound data generated from a plurality of sound signals collected at a plurality of microphones; acquire, from one or more sensors, a result of detecting a position of the sound recording apparatus at a time point during a time period when the plurality of sound signals is collected; and store, in a memory, position data indicating the position of the sound recording apparatus detected at the time point, and sound data generated based on a plurality of sound signals collected at the microphones at the time point at which the position was detected, in association with each other.

Example embodiments of the present invention include a system including a controller to: acquire sound data generated from a plurality of sound signals collected at a plurality of microphones; acquire, from one or more sensors, a result of detecting a position of the sound recording apparatus at a time point during a time period when the plurality of sound signals is collected; and store, in a memory, position data indicating the position of the sound recording apparatus detected at the time point, and sound data generated based on a plurality of sound signals collected at the microphones at the time point at which the position was detected, in association with each other.

Example embodiments of the present invention include a method, performed by a sound recording apparatus, the method including: acquiring sound data generated from a plurality of sound signals collected at a plurality of microphones; acquiring, from one or more sensors, a result of detecting a position of the sound recording apparatus at a time point during a time period when the plurality of sound signals is collected; and storing, in a memory, position data indicating the position of the sound recording apparatus detected at the time point, and sound data generated based on a plurality of sound signals collected at the microphones at the time point at which the position was detected, in association with each other.

Example embodiments of the present invention include carrier means such as a control program to cause one or more processors to execute the above-described method, and a data structure of data generated by performing the above-described method.

Advantageous Effects of Invention

With the configuration described above, sound is successfully reproduced without unnaturalness.

BRIEF DESCRIPTION OF DRAWINGS

The accompanying drawings are intended to depict example embodiments of the present invention and should not be interpreted to limit the scope thereof. The accompanying drawings are not to be considered as drawn to scale unless explicitly noted. Also, identical or similar reference numerals designate identical or similar components throughout the several views.

DESCRIPTION OF EMBODIMENTS

Figure 1:
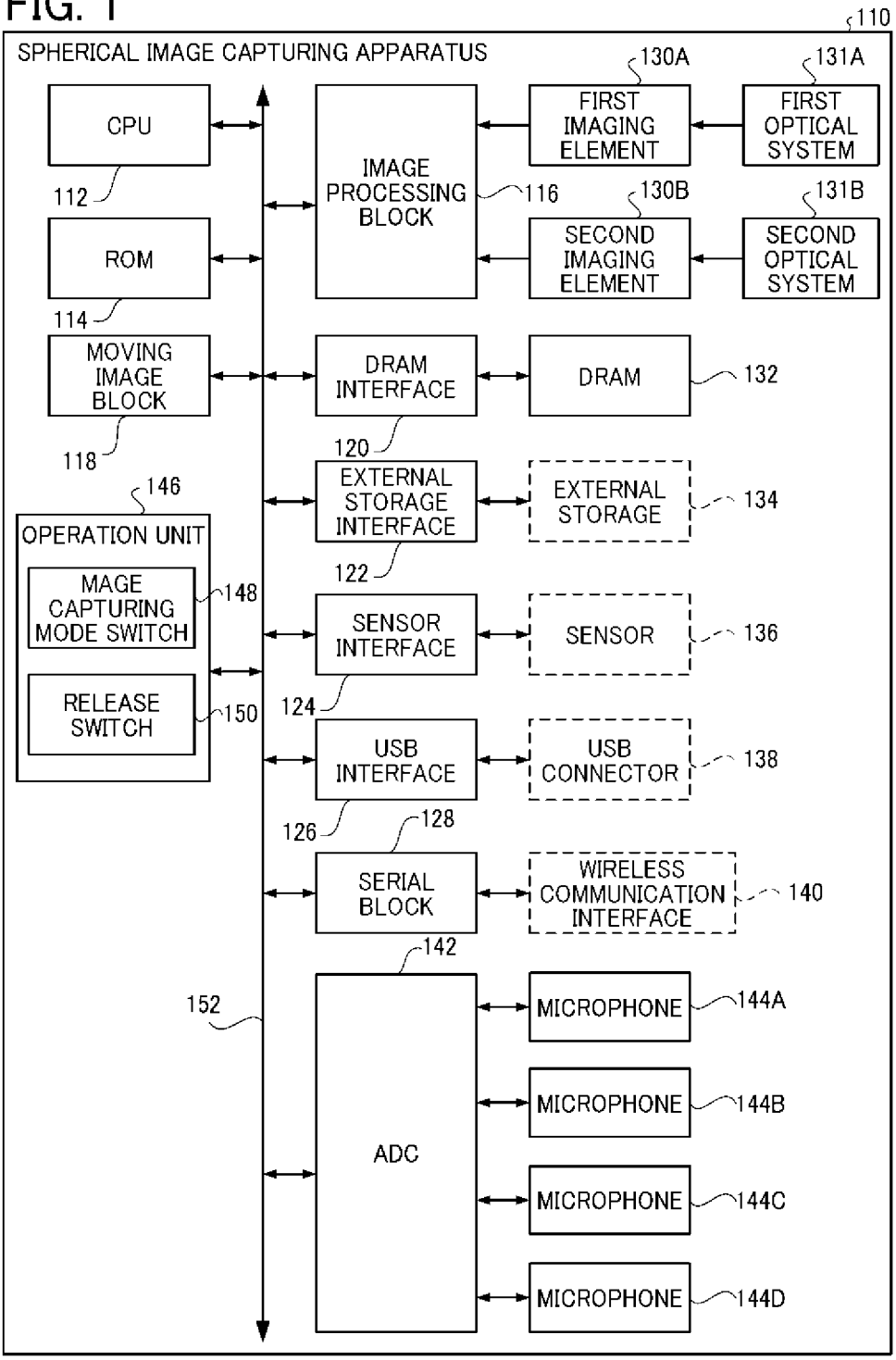
FIG. 1 is a diagram illustrating a hardware configuration of a spherical image capturing apparatus according to an embodiment.

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although embodiments will be described below, embodiments are not limited to the embodiments described below. In the embodiments described below, a spherical image capturing apparatus 110 having a sound recording function will be described as an example of a sound recording apparatus and a sound system. However, the sound recording apparatus and the sound system are not limited to the particular embodiments described below.

In the embodiments described below, the spherical image capturing apparatus 110 includes a plurality of image capturing optical systems each including an image forming optical system and an imaging element. The spherical image capturing apparatus 110 captures images from directions corresponding to the respective image capturing optical systems to generate a captured image. Each of the image capturing optical systems has a total angle of view greater than 180 degrees (=360 degrees/n; n=2), preferably has a total angle of view of 185 degrees or greater, and more preferably has a total angle of view of 190 degrees or greater. The spherical image capturing apparatus 110 combines images captured through the respective image capturing optical systems together to generate an image having a solid angle of 4 p steradians (hereinafter, referred to as a "full-view spherical image"). The full-view spherical image is an image of all the directions that can be seen from the image capturing point. Note that a hemisphere image may be captured by using each optical system.

The spherical image capturing apparatus 110 according to the embodiment further includes sound pickup devices such as a plurality of microphones. The spherical image capturing apparatus 110 records sound data based on sound signals acquired by the respective microphones. Since the recorded sound data can form stereophonic sound, a sound filed including a directivity of sound is reproduced by using a speaker set or a headphone having a predetermined configuration.

A hardware configuration of the spherical image capturing apparatus 110 will be described below first with reference to FIG. 1. FIG. 1 is a diagram illustrating a hardware configuration of the spherical image capturing apparatus 110 according to the embodiment. Note that the spherical image capturing apparatus 110 illustrated in FIG. 1 is configured as a twin-lens spherical image capturing apparatus including two optical systems each having a total field of view greater than 180 degrees.

The spherical image capturing apparatus 110 includes a central processing unit (CPU) 112, a read-only memory (ROM) 114, an image processing block 116, a moving image block 118, a dynamic random access memory (DRAM) 132 connected to a bus 152 via a DRAM interface 120, and a sensor (including at least one of an acceleration sensor, a gyro sensor, and a geomagnetic sensor) 136 connected to the bus 152 via a sensor interface 124.

The CPU 112 controls the respective hardware of the spherical image capturing apparatus 110, to control entire operation of the spherical image capturing apparatus 110. The ROM 114 stores a control program written in code interpretable by the CPU 112 and various parameters.

The spherical image capturing apparatus 110 includes two imaging elements (a first imaging element and a second imaging element) 130A and 130B, each may be implemented by a charge coupled device (CCD) sensor or a complementary metal oxide semiconductor (CMOS) sensor, and two optical systems (a first optical system and a second optical system) 131A and 131B. In the embodiment described herein, each of the optical systems 131A and 131B includes a fish-eye lens. Herein, the term "fish-eye lens" refers to a lens called "wide-angle lens" or "ultra-wide-angle lens". The image processing block 116 is connected to the two imaging elements 130A and 130B and receives image signals of images captured with the two imaging elements 130A and 130B. The image processing block 116 includes an image signal processor (ISP) or the like and performs various processing such as shading correction, Bayer interpolation, white balance correction, gamma correction, etc. on the image signals input from the imaging elements 130A and 130B.

In the embodiment, images captured with the two imaging elements 130A and 130B are subjected to a combining process by the image processing block 116 with reference to an overlapping portion, for example. Consequently, a spherical image having a solid angle of 4 p steradians is generated. Since each of the optical systems 131A and 131B has a total angle of view greater than 180 degrees, captured ranges of portions of the captured images that exceed 180 degrees overlap one another. In the combining process, this overlapping region is referred to as a reference including the same image to generate a spherical image. Consecutive frames of spherical images constitute a spherical moving image. An image capturing unit including the plurality of imaging elements 130A and 130B and the plurality of optical systems 131A and 131B serves as an image capturing unit according to the embodiment.

In the embodiment described herein, the description will be given on the assumption that a full-view spherical video image of all directions that can be seen from the image capturing point is generated as the spherical image. However, the spherical video image is not limited to such an image. In another embodiment, the spherical video image may be a so-called panoramic video image obtained by capturing an image of a 360-degree horizontal plane. That is, in this disclosure, the spherical image, either a still image or video, does not have to be the full-view spherical image. For example, the spherical image may be the wide-angle view image having an angle of about 180 to 360 degrees in the horizontal direction. In addition, in the embodiment described herein, the description will be given on the assumption that the spherical image capturing apparatus 110 includes two image capturing optical systems. However, the number of image capturing optical systems is not limited to a particular value. In other embodiment, the spherical image capturing apparatus 110 may include an image capturing unit including three or more optical systems and may have a function of generating a spherical image based on a plurality of images captured with the three or more optical systems. In another embodiment, the spherical image capturing apparatus 110 may include an image capturing unit including an optical system including a single fish-eye lens and may have a function of generating a spherical image based on a plurality of images captured with the single fish-eye lens in different directions.

The moving image block 118 is a codec block that compresses or decompresses a moving image according to H.264 (Moving Picture Experts Group (MPEG)-4 Advanced Video Coding (AVC))/H.265 (International Organization for Standardization/International Electrotechnical Commission (ISO/IEC) 23008-2 High Efficiency Video Coding (HEVC)). The DRAM 132 provides a memory area for temporarily storing data when various kinds of signal processing and image processing are performed on the data.

The sensor 136 measures a physical quantity, such as a velocity, an acceleration, an angular velocity, an angular acceleration, or a magnetic direction, which results from a movement of the spherical image capturing apparatus 110. The measured physical quantity is used to perform at least one of: zenith correction on a spherical image and sound; and correction on rotation of a horizontal face with respect to a reference direction on the spherical image and sound. The measured physical quantity indicates the position of the spherical image capturing apparatus 110. The sensor 136 serves as a measuring device that measures the position of the spherical image capturing apparatus 110 according to the embodiment. While in this embodiment, the sensor is provided in the spherical image capturing apparatus 110, the external sensor may be connected to the spherical image capturing apparatus 110 to output a detection result to the spherical image capturing apparatus 110.

For example, a publicly known three-axis acceleration sensor is usable as the acceleration sensor. The acceleration sensor detects accelerations along the respective axes. Examples of the acceleration sensor include a piezo-resistive acceleration sensor, a capacitive acceleration sensor, and a heat-detection acceleration sensor. For example, a publicly known angular velocity sensor capable of detecting angular velocities in directions of three axes is usable as the gyro sensor. The geomagnetic sensor detects geomagnetism of the Earth in directions of three axes to determine a direction of each cardinal point (angle of direction or magnetic north) relative to the spherical image capturing apparatus 110 serving as the origin. Examples of the geomagnetic sensor include a publicly known three-axis electronic compass.

The spherical image capturing apparatus 110 includes an external storage interface 122. An external storage 134 is connected to the external storage interface 122. The external storage interface 122 controls read and write operations performed on the external storage 134, such as a memory card inserted into a memory card slot of the spherical image capturing apparatus 110. The external storage 134 is usable as a recording medium that stores spherical moving image data and corresponding sound data. Note that the spherical moving image data and the corresponding sound data may be temporarily stored in the DRAM 132 or the like, and various kinds of processing may be performed by an external apparatus.

The spherical image capturing apparatus 110 includes a Universal Serial Bus (USB) interface 126. A USB connector 138 is connected to the USB interface 126. The USB interface 126 controls USB-based communication performed with an external apparatus, such as a personal computer, a smartphone, or a tablet computer connected to the spherical image capturing apparatus 110 via the USB connector 138. The spherical image capturing apparatus 110 includes a serial block 128. The serial block 128 controls serial communication performed with an external apparatus. A wireless communication interface 140 is connected to the serial block 128.

An external apparatus, such as a personal computer, a smartphone, or a tablet computer, can be connected to the spherical image capturing apparatus 110 via the USB connector 138 or the wireless communication interface 140. In addition, a video image captured by the spherical image capturing apparatus 110 can be displayed on a display included in or connected to the external apparatus. The spherical image capturing apparatus 110 may include a video output interface, such as High-Definition Multimedia Interface (HDMI) (trademark or registered trademark), in addition to the interfaces illustrated in FIG. 1. In such a case, the spherical image capturing apparatus 110 is directly connected to an external display device, such as a display, via the video output interface, and a video image can be displayed on the external display device.

The spherical image capturing apparatus 110 according to the embodiment includes an analog-to-digital converter (ADC) 142 and a plurality of microphones 144 connected to the ADC 142. Each of the microphones 144 picks up sound from a surrounding environment of the spherical image capturing apparatus 110 and inputs a sound signal of the picked-up sound to the ADC 142. The ADC 142 performs sampling on the sound signal input from each of the microphones 144 to convert the sound signal into digital sound data. In the embodiment described herein, the microphones 144 include four microphones 144A to 144D that have a predetermined arrangement and are preferably Ambisonics microphones. The microphones 144 serve as sound pickup devices each of which picks up sound from a surrounding environment in the embodiment. In the embodiment, the microphones 144 built in the spherical image capturing apparatus 110 are described. However, microphones externally connected to the spherical image capturing apparatus 110 may be provided.

In the above-described embodiment, any one of the storage 134, sensor 136, USB connector 138, wireless communication interface 140 may be provided internally or externally to the spherical image capturing apparatus 110.

The spherical image capturing apparatus 110 includes an operation unit 146 that accepts various operation instructions given by the user. The operation unit 146 includes, but not limited particularly to, an image capturing mode switch 148 and a release switch 150. The operation unit 146 may include a switch for accepting another operation instruction in addition to the image capturing mode switch 148 and the release switch 150. The image capturing mode switch 148 accepts an instruction to switch between a moving image capturing mode and a still image capturing mode from the user. The release switch 150 accepts an instruction for image capturing from the user.

The spherical image capturing apparatus 110 is powered on in response to a power-on operation, such as a long-pressing operation of the release switch 150. In response to the power-on of the spherical image capturing apparatus 110, a control program is read from the ROM 114 or the like and is loaded to the main memory such as the DRAM 132. The CPU 112 controls operations of the respective hardware of the spherical image capturing apparatus 110 in accordance with the program loaded to the main memory such as the DRAM 132 and temporarily stores data used for control in the memory. Consequently, functional units and processes of the spherical image capturing apparatus 110 relating to recording of images and sound are implemented.

A moving image captured by the spherical image capturing apparatus 110 can be browsed or viewed by using an external apparatus including a dedicated image viewer application, for example. Examples of the external apparatus include a personal computer, a smartphone, and a tablet computer. Alternatively, a display device can be connected to the spherical image capturing apparatus 110 via a video output interface such as HDMI (trademark or registered trademark) or via the wireless communication interface 140 such as Miracast (trademark or registered trademark) or AirPlay (trademark or registered trademark), and the moving image can be browsed or viewed by using the display device.

Recording is performed not only in a state in which the spherical image capturing apparatus 110 is fixed using a tripod but also in a state in which the spherical image capturing apparatus 110 is held by a hand. That is, the position and the location of the spherical image capturing apparatus 110 are not necessarily always fixed. Thus, the viewer may feel that the direction of sound recorded by using the microphones 144 deviates from the direction intended by the viewer because of a change in the position of the spherical image capturing apparatus 110 during image capturing and recording. When zenith correction is performed on a spherical image but the zenith direction is not corrected for sound recorded by using the microphones 144 in response to the zenith correction, the viewer may feel the deviation more.

Image-sound recording functions included in the spherical image capturing apparatus 110 according to the embodiment to reduce unnaturalness that results from a change in the position of the spherical image capturing apparatus 110 and that is felt during viewing will be described below with reference to FIGS. 2 to 7E.

Figure 2:
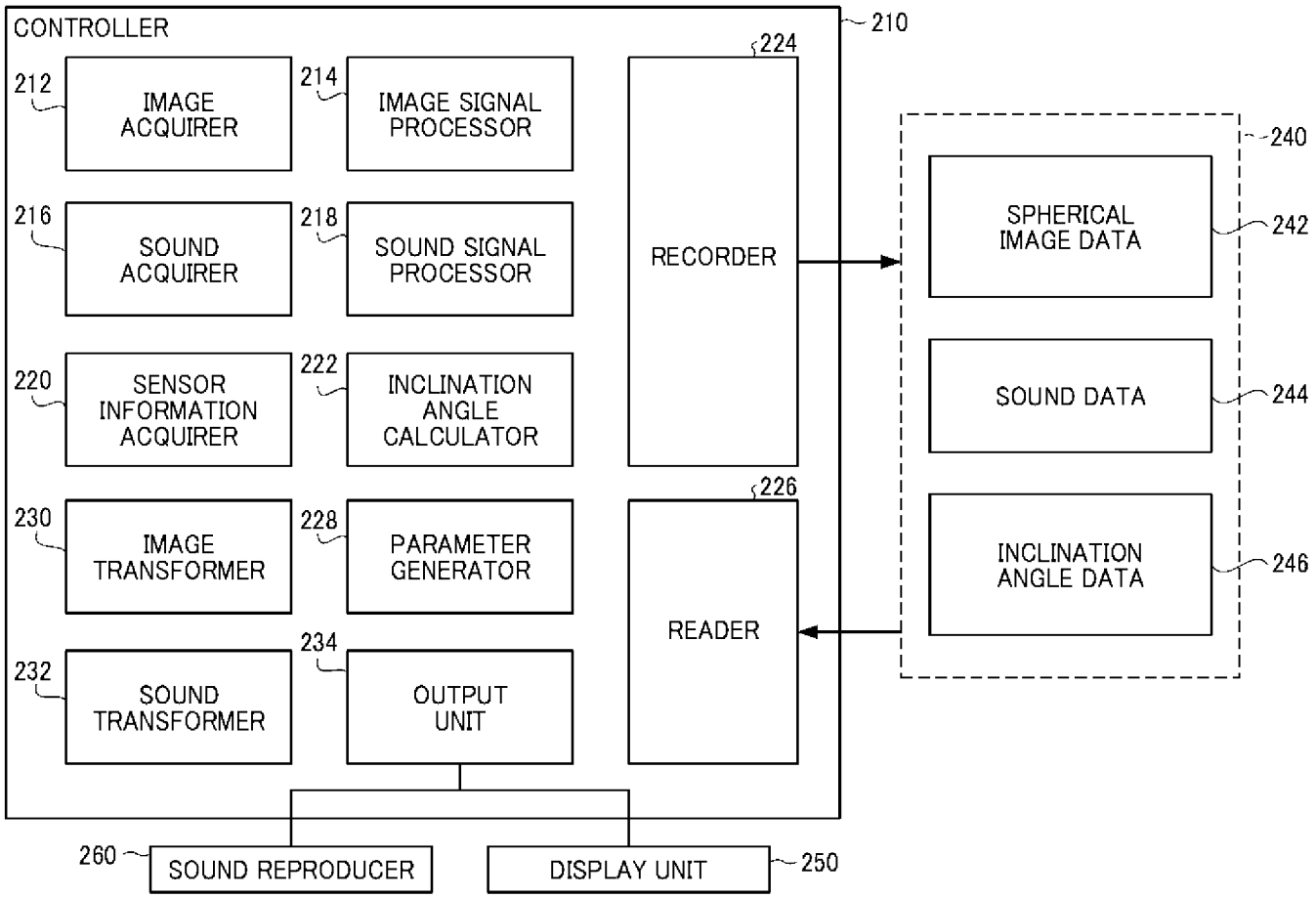
FIG. 2 is a functional block diagram relating to image-sound recording functions implemented in the spherical image capturing apparatus according to the embodiment.

FIG. 2 illustrates functional blocks of a controller 210 relating to the image-sound recording functions implemented in the spherical image capturing apparatus 110 according to the embodiment. Note that FIG. 2 illustrates a display unit 250 and a sound reproducer 260 as components external to the spherical image capturing apparatus 110.

As illustrated in FIG. 2, the controller 210 of the spherical image capturing apparatus 110 includes an image acquirer 212, an image signal processor 214, a sound acquirer 216, a sound signal processor 218, a sensor information acquirer 220, an inclination angle calculator 222, and a recorder 224 as functional blocks. Note that part or entirety of the controller 210 illustrated in FIG. 2 may be implemented as a result of the CPU 112 executing a program or may be implemented by using the image processing block 116, for example.

The image acquirer 212 acquires images captured by the imaging elements 130A and 130B through the optical systems 131A and 131B, respectively. The image signal processor 214 performs various kinds of image signal processing relating to a spherical image acquired by the image acquirer 212. Specifically, the image signal processor 214 performs signal processing such as optical black (OB) correction processing, a defective pixel correction processing, linear correction processing, shading correction processing, a region division averaging processing, white balance (WB) processing, gamma correction processing, Bayer interpolation processing, YUV conversion processing, YCFLT processing, and color correction processing on the captured image. In the embodiment described herein, image signal processing is performed on a hemisphere image acquired from the first imaging element 130A and on a hemisphere image acquired from the second imaging element 130B, and the hemisphere images are linked and combined together. Consequently, a full-view spherical image is generated.

The sound acquirer 216 acquires, via the ADC 142, digital sound data based on a plurality of sound signals picked up from the surrounding environment by the plurality of microphones 144A to 144D illustrated in FIG. 1. The sound acquirer 216 serves as a sound acquirer that acquires sound information. The sound signal processor 218 performs publicly known noise reduction on the acquired sound data.

The sensor information acquirer 220 acquires sensor detection result information regarding accelerations in the three-axis directions, angular velocities in the three-axis directions, and a direction of each cardinal point (azimuth angle or magnetic north) at a predetermined time point from the respective sensors of the sensor 136. Note that the direction of each cardinal point is optional. Thus, there is a case where the direction of each cardinal point is not acquired when the sensor 136 does not include a geomagnetic sensor. The sensor detection result information such as the measured accelerations and angular velocities along the respective axes and the direction of each cardinal point indicates the position of the spherical image capturing apparatus 110 at the predetermined time point. The sensor information acquirer 220 serves as a position acquirer that acquires a measured position of the spherical image capturing apparatus 110 in the embodiment.

The inclination angle calculator 222 calculates an inclination angle of the spherical image capturing apparatus 110 relative to the zenith direction serving as a reference direction, based on the sensor detection result information for the predetermined time point. The zenith direction indicates a direction right above the user in the sphere and matches the anti-vertical direction. The inclination angle of the spherical image capturing apparatus 110 relative to the zenith direction indicates an inclination of a direction along a plane opposing the optical systems 131A and 131B of the spherical image capturing apparatus 110 relative to the zenith direction.

In one example, the inclination angle calculator 222 calculates a rotation angle of a horizontal face with respect to a front direction, as a reference direction, based on sensor information at a predetermined point in time. In this disclosure, the front direction corresponds to a direction that a front face of the spherical image capturing device 110 faces. For example, the direction that the optical system 131A faces at the time of image capturing may be defined as a predetermined front direction. The direction along the horizontal face is orthogonal to a vertical direction, irrespective of an inclination angle of the spherical image capturing device 110. In case the gyro sensor is used, the rotation angle of the horizontal face with respect to the front direction at the start of image capturing, is calculated by integrating angular speeds obtained by the gyro sensor from the start of image capturing. In case the geomagnetic sensor is used, the rotation angle of the horizontal face is calculated, as an angle with respect to a specific direction of the spherical image capturing device 110 that is defined as the front direction, based on sensor information detected by the geomagnetic sensor. The specific direction is a specific azimuth angle, for example, south or north.

The recorder 224 records the position of the spherical image capturing apparatus 110 measured at the predetermined time point, sound information based on sound signals acquired by the plurality of microphones 144 at a time point corresponding to the time point at which the position was measured, and image information based on a plurality of image signals acquired by the plurality of imaging elements 130A and 130B in association with one another. The recorder 224 serves as a recorder in the embodiment.

In the embodiment described herein, image information to be recorded is spherical image data 242 obtained by combining hemisphere images captured with the plurality of imaging elements 130A and 130B together. It is assumed in the embodiment described herein that at least one of zenith correction and rotation correction in a horizontal face is performed at the time of reproduction and a spherical image obtained by combining captured hemisphere images together is recorded as the spherical image data 242. However, a corrected spherical image obtained by performing at least one of zenith correction and rotation correction on the spherical image may be recorded. In addition, the image information is not limited to spherical image data. In another embodiment, image data including a plurality of hemisphere images captured with the plurality of imaging elements 130A and 130B may be recorded on the assumption that the plurality of hemisphere images are linked and combined together at the time of reproduction.

In addition, in the embodiment described herein, sound information to be recorded is sound data 244 acquired by each of the plurality of microphones 144. When the first-order Ambisonics is adopted as the stereophonic sound technique, the sound data 244 may be data referred to as "A-format (LF, RF, LB, and RB)". Recording of the sound data 244 of each of the microphones 144 allows the sound data to be recorded in a state as close to the original as possible, compared with the case where sound data is converted into stereophonic sound data, such as B-format or the like, and then the resultant sound data is stored. In addition, in the embodiment described herein, the first-order Ambisonics is described as an example of the stereophonic sound technique. However, the stereophonic sound technique used is not limited to the first-order Ambisonics. In another embodiment, a higher-order Ambisonics (HOA) or FWS may be adopted as the stereophonic sound technology.

In the embodiment described herein, the position is recorded, as inclination angle data 246, in a form of an inclination angle relative to the zenith direction calculated by the inclination angle calculator 222 based on the sensor detection result information acquired from the sensor 136 via the sensor information acquirer 220. Further, the inclination angle data 246 may include a rotation angle of a horizontal face with respect to a predetermined front direction.

Figure 3:
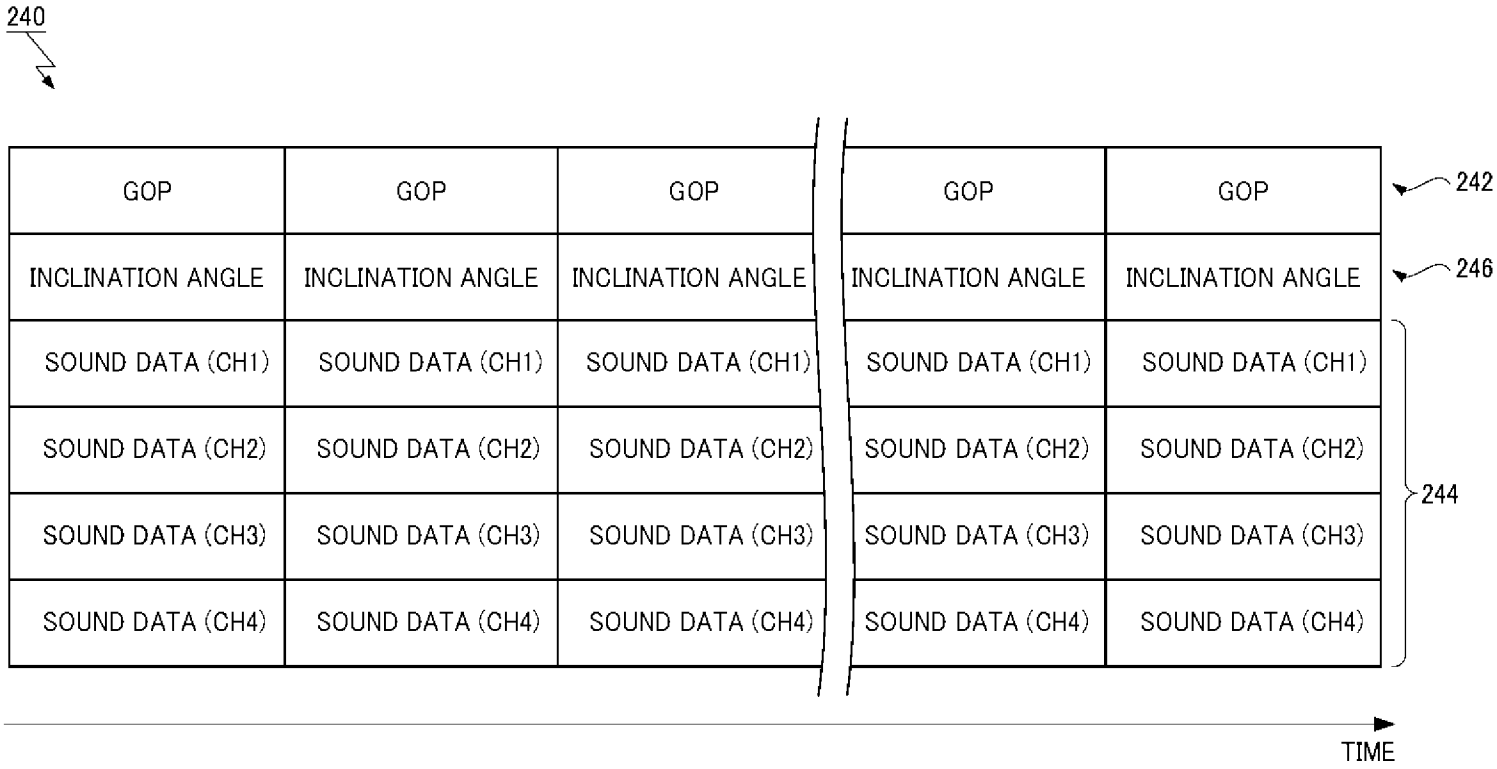
FIG. 3 is a diagram illustrating a data structure of a file recorded by the spherical image capturing apparatus according to the embodiment.

A file 240 including the spherical image data 242, the sound data 244, and the inclination angle data 246 is temporarily stored in the external storage 134, for example. FIG. 3 illustrates a data structure of the file 240 recorded in the spherical image capturing apparatus 110 according to the embodiment. As illustrated in FIG. 3, the file 240 includes a channel for the spherical image data 242, a channel for the inclination angle data 246, and a channel for the sound data 244. In the embodiment illustrated in FIG. 3, the spherical image data 242 is recorded in an MPEG format and is encoded in units called Group of Pictures (GOP). A GOP is a unit group of frames including at least one reference frame (I-picture in MPEG).

Referring to FIG. 3, the sound data 244 and the inclination angle data 246 are also sectioned and recorded in a time period corresponding to a GOP and are associated with each other so that the recording times of the inclination angle data 246 and the sound data 244 match with reference to the start of recording. Thus, the inclination angle data 246 and the sound data 244 are successfully synchronized by using a time period elapsed from the start of recording. The sound data 244 may be in an uncompressed sound format, such as Pulse Code Modulation (PCM) format, for example, or in a compressed sound format, such as MPEG Layer 3 (MP3). In the embodiment described herein, the sound data 244 is recorded for each of channels of the plurality of microphones 144A to 144D as illustrated in FIG. 3.

In the embodiment described herein, the spherical image data 242, the sound data 244, and the inclination angle data 246 are stored, but not limited particularly to, in a single file 240 for the sake of convenience. In another embodiment, the spherical image data 242, the sound data 244, and the inclination angle data 246 may be stored in different files. In addition, in the embodiment described herein, the position, the image information, and the sound information are associated with one another in units of frame groups. However, the association manner is not limited to this one, and the position information, the image information, and the sound information may be associated with one another in units of frames.

Referring back to FIG. 2, the controller 210 of the spherical image capturing apparatus 110 includes a reader 226, a parameter generator 228, an image transformer (converter) 230, a sound transformer (converter) 232, and an output unit 234 as functional units.

The reader 226 reads the file 240 to sequentially read the recorded position of the spherical image capturing apparatus 110 at the predetermined time point, the sound information corresponding to the predetermined time point at which the position was measured, and the corresponding image information.

The parameter generator 228 generates projective transformation parameters for each predetermined time point that are applied to the spherical image and the sound, from the inclination angle for the predetermined time point included in the read inclination angle data 246. When the inclination angle data 246 includes a rotation angle of a horizontal face to a predetermined front direction, the parameter generator 228 generates projection transformation parameters for each predetermined time point from the inclination angle and the rotation angle for the predetermined time point. Note that the projective transformation parameter applied to the spherical image and the projective transformation parameter applied to the sound may be different from each other.

When at least one of zenith correction and rotation correction is desired, the image transformer 230 performs projective transformation on each frame image of the spherical image data 242 by using the projective transformation parameter generated by the parameter generator 228. Since information regarding the inclination angle is associated with each GOP in the data structure illustrated in FIG. 3, the projective transformation parameter generated based on the same inclination angle may be applied to a group of frames corresponding to a GOP. Alternatively, a projective transformation parameter based on an inclination angle that is smoothed using an inclination angle for an adjacent GOP may be applied to each frame in the group of frames. In addition, if the file 240 includes image data of a plurality of hemisphere images instead of the spherical image data, the image transformer 230 can link and combine the plurality of hemisphere images together prior to projective transformation. In addition, if at least one of zenith correction and rotation correction has been performed on the spherical image data, projective transformation may be omitted. Since projective transformation can be performed on spherical images by using a publicly known technique, a detailed description thereof is omitted.

The sound transformer 232 performs projective transformation on sound data of each time period of the sound data 244 by using the projective transformation parameter generated for the time period by the parameter generator 228. In the embodiment described herein, since the sound data 244 includes pieces of sound data for the respective microphones 144, coarse zenith correction and/or rotation correction is successfully performed through a channel exchange in accordance with a range corresponding to the position of the spherical image capturing apparatus 110. For example, when the spherical image capturing apparatus 110 is placed horizontally, zenith correction is successfully performed by using a method in which the positional relationships among the channels are rotated by 90 degrees with respect to the case where the spherical image capturing apparatus 110 is held vertically.

Note that, for example, the operation unit 146 of the spherical image capturing apparatus 110 includes a selection unit that receives a selection regarding whether to perform zenith correction at the time of reproduction. The projective transformation performed by the image transformer 230 and the projective transformation performed by the sound transformer 232 are simultaneously enabled when a selection to perform the zenith correction is received. Alternatively or additionally, the operation unit 146 includes a selection unit that receives a selection regarding whether to perform rotation correction of a horizontal face at the time of reproduction. The projective transformation performed by the image transformer 230 and the projective transformation performed by the sound transformer 232 are simultaneously enabled when a selection to perform the rotation correction is received. The selection of whether to perform rotation correction may be performed independently from or together with selection of whether to perform zenith correction. Alternatively, the selection of whether to perform rotation correction may be automatically performed, when the selection to perform zenith correction is received.

The output unit 234 generates a video signal based on the frames of the spherical images obtained by the projective transformation performed by the image transformer 230 and outputs the video signal to the display unit 250. A method for displaying spherical images is not limited to a particular method. The spherical images may be output as the video signal without any processing, or an image range corresponding to a predetermined angle of view may be clipped from the spherical images and the clipped image range may be output as the video signal.

The output unit 234 generates a speaker driving signal based on the sound data obtained by the projective transformation performed by the sound transformer 232 and outputs the speaker driving signal to the sound reproducer 260 simultaneously with the output of the video signal. The sound reproducer 260 includes a plurality of loud speakers placed in a predetermined arrangement. The sound reproducer 260 may have a unique arrangement or may comply with a predetermined standard, such as 5.1-ch, 7.1-ch, or 22.2-ch surround sound. The output unit 234 generates the speaker driving signal in accordance with the configuration of the sound reproducer 260 and outputs the generated speaker driving signal.

Methods for recording and reproducing images and sound that are carried out by the spherical image capturing apparatus 110 according to the embodiment will be described in detail below with reference to FIGS. 4 and 5.

Figure 4:
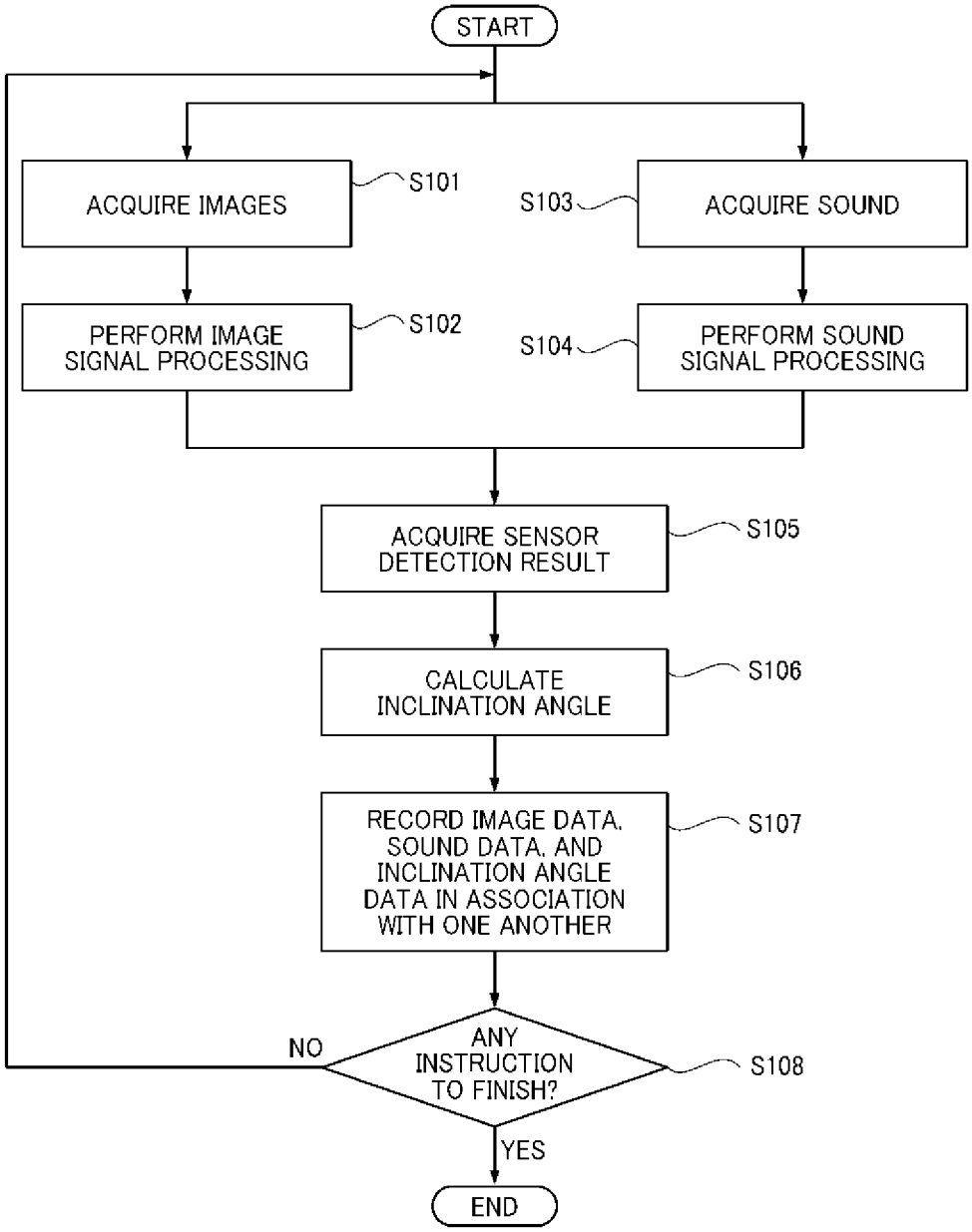
FIG. 4 is a flowchart illustrating an image-sound recording method carried out by spherical image capturing apparatus according to the embodiment.

FIG. 4 is a flowchart illustrating an image-sound recording method carried out by the spherical image capturing apparatus 110, specifically, under control of the CPU 112, according to the embodiment. The process illustrated in FIG. 4 starts in response to a specific operation performed to input an instruction to start recording, such as pressing of the release switch 150 provided on the casing of the spherical image capturing apparatus 110, for example.

In step S101, the image acquirer 212 of the spherical image capturing apparatus 110 acquires images captured by using the imaging elements 130A and 130B. In step S102, the image signal processor 214 of the spherical image capturing apparatus 110 performs image signal processing on the images acquired in step S101. The process then proceeds to step S105. It is assumed that the image acquisition and the image signal processing are performed in units of frame groups in steps S101 and S102.

After the process illustrated in FIG. 4 is started, processing of steps S103 and S104 is performed in parallel to the processing of steps S101 and S102. In step S103, the sound acquirer 216 of the spherical image capturing apparatus 110 acquires pieces of sound data for the respective microphones 144A to 144D from the microphones 144A to 144D via the ADC 142. In step S104, the sound signal processor 218 of the spherical image capturing apparatus 110 performs signal processing on the pieces of sound data acquired in step S103. The process then proceeds to step S105. It is assumed that the sound acquisition and the sound signal processing are performed for a time period corresponding to each frame group.

In step S105, the sensor information acquirer 220 of the spherical image capturing apparatus 110 acquires, from the sensor 136, sensor detection result information corresponding to the time period for which the images and the sound acquired in steps S101 and S103 are recorded. In step S106, the inclination angle calculator 222 of the spherical image capturing apparatus 110 calculates the inclination angle and the rotation angle of the horizontal face to the predetermined front direction of the spherical image capturing apparatus 110 at the time of recording based on the sensor detection result information acquired in step S105. The rotation angle is not acquired in some cases, such as in the case where the sensor 136 does not include a gyro sensor or a geomagnetic sensor.

In step S107, the recorder 224 of the spherical image capturing apparatus 110 records image information for a frame group, corresponding sound information, and corresponding position information in association with one another as the spherical image data 242, the sound data 244, and the inclination angle data 246, respectively.

In step S108, the spherical image capturing apparatus 110 determines whether an instruction to finish recording is accepted. If it is determined in step S108 that an instruction to finish recording is not accepted yet (NO), the process returns to steps S101 and S103 to perform processing on a next frame group. On the other hand, if it is determined in step S108 that an instruction to finish recording is accepted (YES), the process ends. When ending, the spherical image capturing apparatus 110 closes the file.

Figure 5:
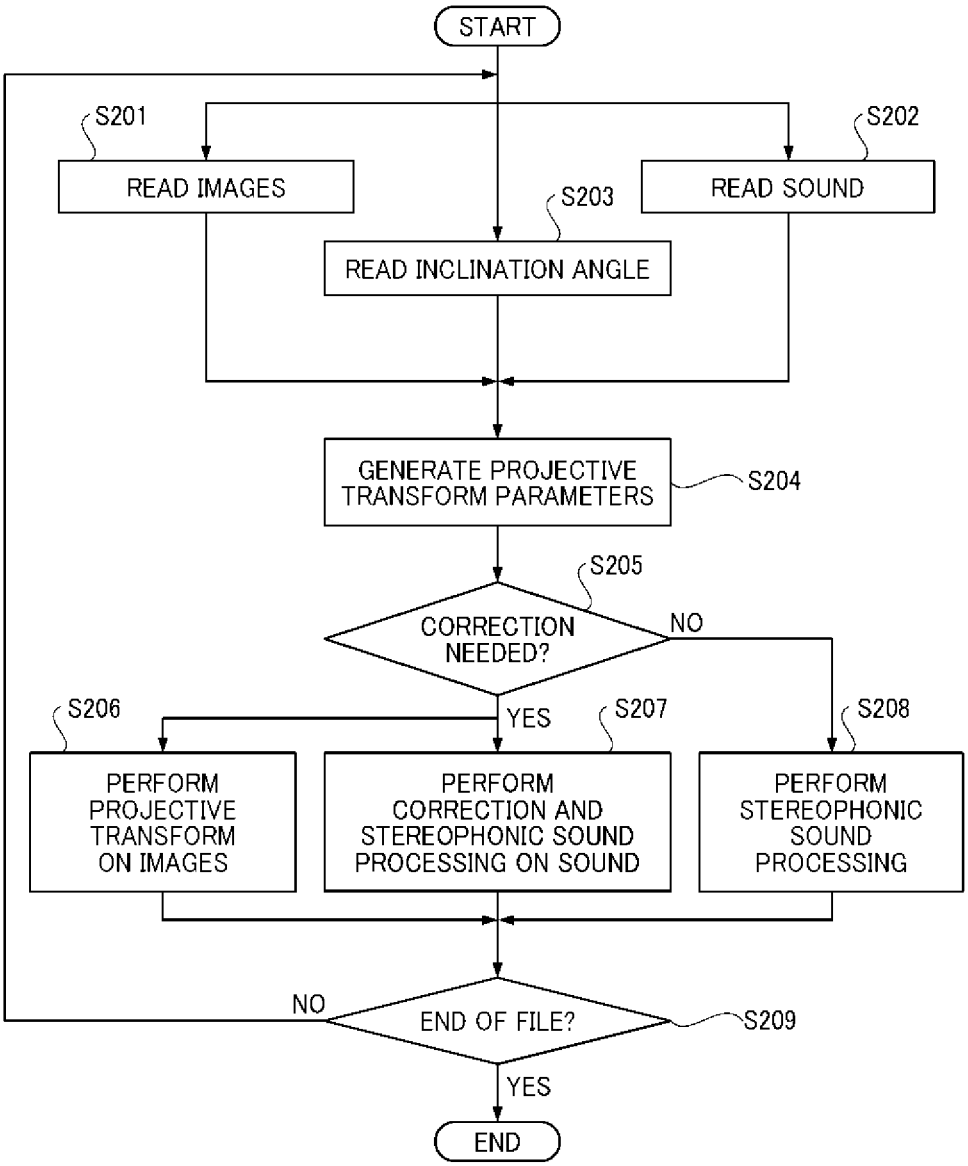
FIG. 5 is a flowchart illustrating an image-sound reproduction method carried out by the spherical image capturing apparatus according to the embodiment.

FIG. 5 is a flowchart illustrating an image-sound reproduction method carried out by the spherical image capturing apparatus 110, under control of the CPU 112, according to the embodiment. The process illustrated in FIG. 5 starts in response to a specific operation, such as pressing of a play button provided on the casing of the spherical image capturing apparatus 110, for example. After the process illustrated in FIG. 5 is started, processing of step S201, processing of step S202, and processing of step S203 are performed in parallel to one another.

In step S201, the reader 226 of the spherical image capturing apparatus 110 reads images of a frame group from the spherical image data 242 of the file 240. In step S202, the reader 226 of the spherical image capturing apparatus 110 reads sound data corresponding to the frame group from the sound data 244 of the file 240. In step S203, the reader 226 of the spherical image capturing apparatus 110 reads an inclination angle corresponding to the frame group from the inclination angle data 246 of the file 240.

In step S204, the parameter generator 228 of the spherical image capturing apparatus 110 generates projective transformation parameters to be applied to the images and the sound of the frame group based on the inclination angle and the rotation angle of the horizontal face to the predetermined front direction. In step S205, the spherical image capturing apparatus 110 determines whether to perform zenith correction and rotation correction with reference to the setting information. In this embodiment, it is assumed that the setting information indicates whether to perform both of zenith correction and rotation correction, or to perform none of zenith correction and rotation correction. Alternatively, whether to perform zenith correction and rotation correction may be selected, independently from each other. That is, the spherical image capturing device 110 may determine to perform: only zenith correction, only rotation correction, both of zenith correction and rotation correction, and none of zenith correction and rotation correction. If the spherical image capturing apparatus 110 determines to perform zenith correction and rotation correction in step S205 (YES), the process proceeds to steps S206 and S207.

In step S206, the image transformer 230 of the spherical image capturing apparatus 110 performs projective transformation on the read spherical images of the frame group by using the projective transformation parameter generated for the images. At the same time, in step S207, the spherical image capturing apparatus 110 performs stereophonic sound signal processing including zenith correction and rotation correction on the read sound data. In the stereophonic sound signal processing including zenith correction and rotation correction, the sound transformer 232 performs zenith correction and rotation correction through a channel exchange of the pieces of sound data for the respective microphones 144 by using the projective transformation parameter for sound. In the stereophonic sound signal processing including zenith correction and rotation correction, the output unit 234 encodes the corrected sound data, decodes the encoded stereophonic sound data in accordance with a specification of the sound reproducer 260 to generate a speaker driving signal, and outputs the speaker driving signal to the sound reproducer 260.

On the other hand, if the spherical image capturing apparatus 110 determines to perform none of zenith correction and rotation correction in step S205 (NO), the process branches to step S208. In step S208, the spherical image capturing apparatus 110 performs stereophonic sound signal processing on the read sound data without performing any processing on the spherical images. In this stereophonic sound signal processing, the output unit 234 encodes the pieces of sound data for the respective microphones 144, decodes the encoded stereophonic sound data in accordance with the configuration of the sound reproducer 260 to generate a speaker driving signal, and outputs the speaker driving signal to the sound reproducer 260.

In step S209, the spherical image capturing apparatus 110 determines whether the end of the file has been reached. If it is determined in step S209 that the end of the file has not been reached (NO), the process returns to steps S201, S202, and S203, in which processing is performed on the next frame group. On the other hand, it is determined in step S209 that the end of the file has been reached (YES), the process ends. When ending, the spherical image capturing apparatus 110 closes the file.

Although the image-sound recording and reproduction methods have been described separately with reference to FIGS. 4 and 5, zenith correction and rotation correction performed at the time of reproduction in FIG. 5 may be performed simultaneously with recording at the time of image capturing.

Figure 6A:
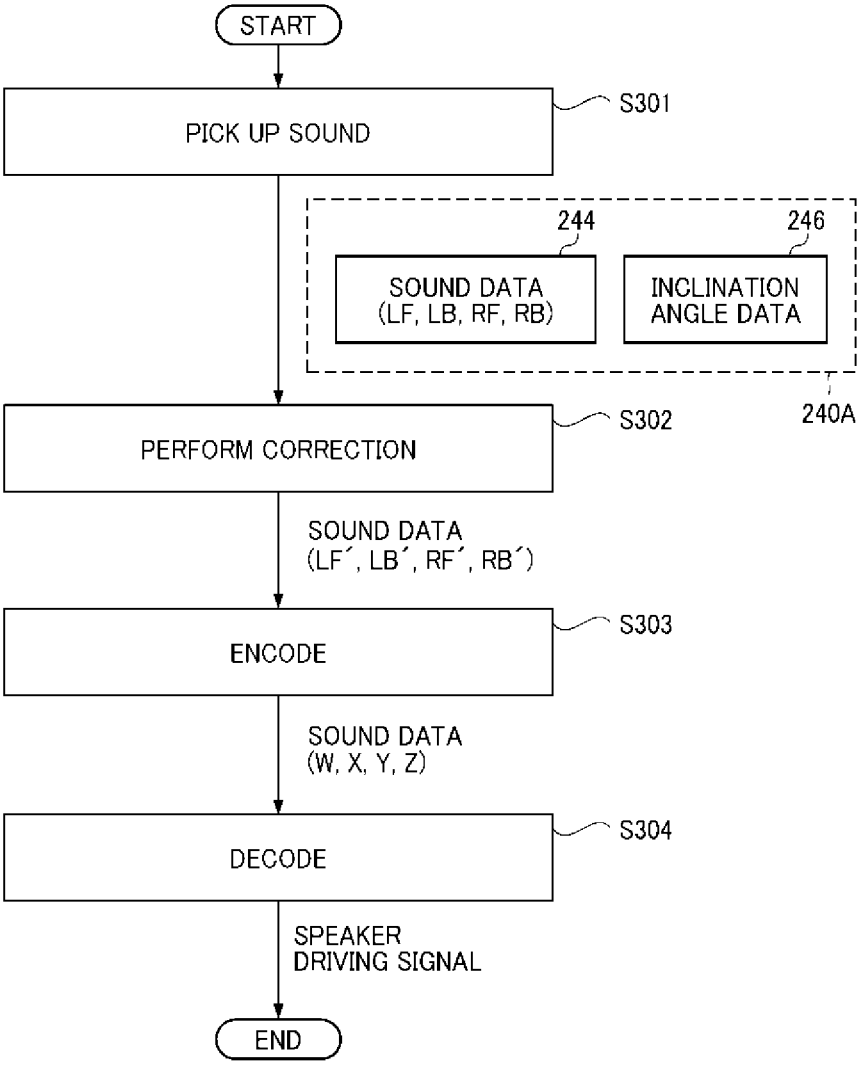
FIG. 6A is a flowchart illustrating a flow from acquisition to reproduction of sound data in an example in which Ambisonics is adopted as a stereophonic sound technique.

A flow from acquisition to reproduction of sound data in a certain embodiment in which Ambisonics is adopted as the stereophonic sound technique will be described below with reference to FIGS. 6A to 7E. FIG. 6A illustrates a flow from acquisition to reproduction of sound data in the embodiment.

As illustrated in FIG. 6A, in the embodiment, acquired pieces of sound data for the respective microphones 144 (LF, LB, RF, and RB of the A-format of Ambisonics) are recorded as the sound data 244 in association with the inclination angle data 246 in a file 240A (S301). The sound data 244 is read from the file 240A at the time of reproduction, and zenith correction and rotation correction are then performed on the sound data 244 (S302). The zenith-corrected or rotation-corrected sound data (LF', LB', RF', and RB' of the A-format) is encoded by an Ambisonics encoder (S303), and consequently stereophonic sound data (W, X, Y, and Z of the B-format) is generated. The encoding can be typically represented using Equation (1) below. The microphones 144 used in Ambisonics are four directional microphones arranged at respective vertices of a regular tetrahedron, and sound is picked up by using such microphones. A non-directional signal W and bidirectional signals X, Y, and Z are generated from the four acquired sound signals.

As a result of signal processing to converting the A-format into the B-format, the non-directional signal W and the bidirectional signals X, Y, and Z are handled as signals recorded by using a virtual non-directional microphone and virtual bidirectional microphones.

[Math.1]

$$X=LF-RB+RF-LB$$

$$Y=LF-RB-RF+LB$$

$$Z=LF-LB+RB-RF$$

$$W=LB-LF+RF-RB \qquad \text{Equation (1)}$$

Figure 7A:
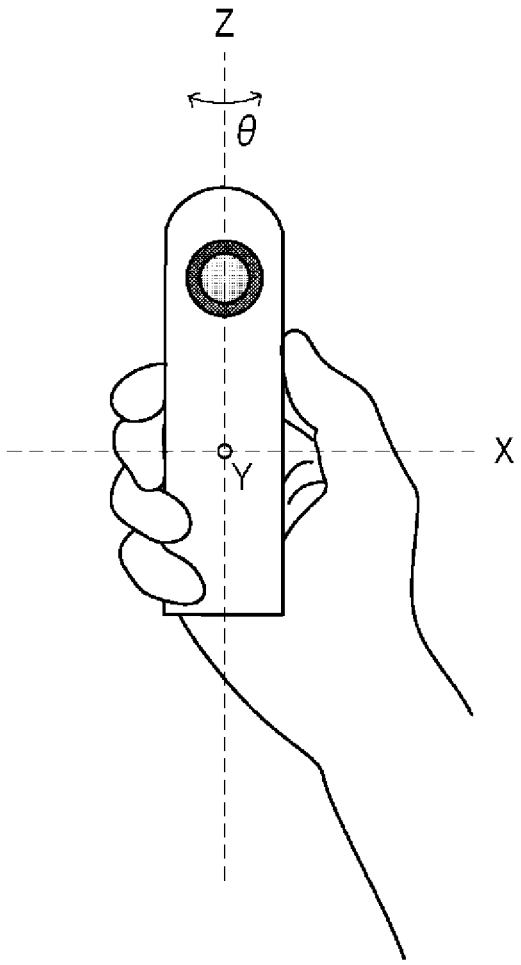
FIGS. 7A to 7E are diagrams illustrating coordinate axes of stereophonic sound according to examples.
Figure 7B:
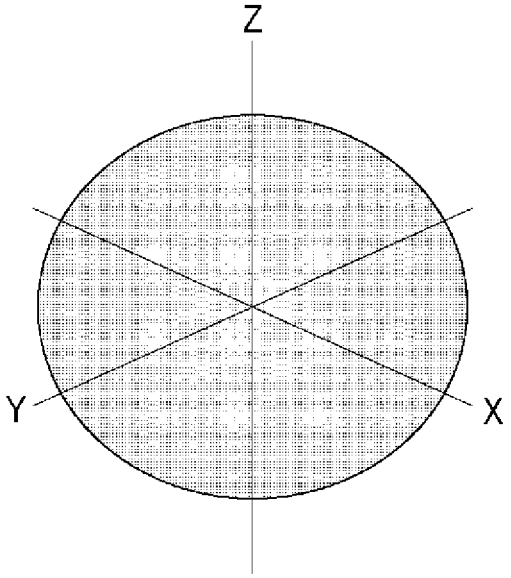
Figure 7C:
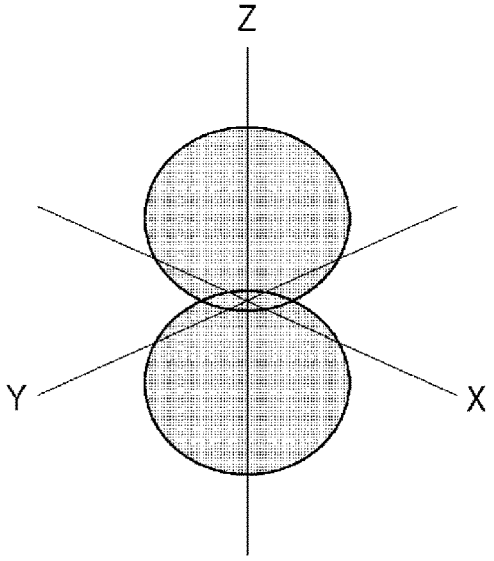
Figure 7D:
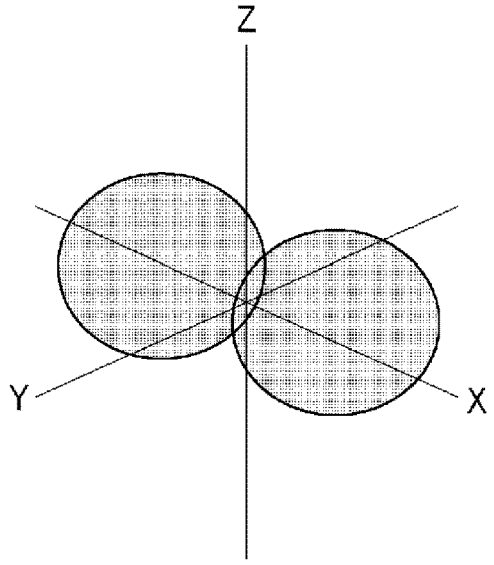
Figure 7E:
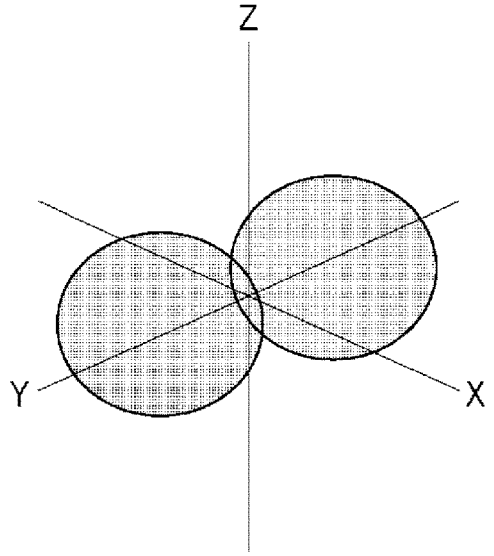

FIG. 7A is a diagram illustrating definitions of axes in the spherical image capturing apparatus 110. As illustrated in FIG. 7A, the top-bottom direction is associated with the Z axis, the left-right direction is associated with the X axis, and the front-rear direction is associated with the Y axis. FIGS. 7B to 7E are diagrams describing sound pickup directional characteristics of stereophonic sound, for example. The W-channel of the B-format corresponds to a sound signal acquired by using a non-directional microphone as illustrated in FIG. 7B. The X-channel, the Y-channel, and the Z-channel of the B-format correspond to sound signals acquired by using bidirectional microphones as illustrated in FIGS. 7C, 7D, and 7E, respectively. The stereophonic sound data is created from the pieces of sound data for the respective microphones through simple calculations performed between signals as indicated by Equation (1).

After the stereophonic sound data is generated, a speaker driving signal is generated by the Ambisonics decoder in accordance with the configuration of loud speakers and is input to the sound reproducer 260 (S304). Consequently, corresponding sound is emitted by each loud speaker of the sound reproducer 260. In this way, a sound field including the directivity is reproduced.

The above description has been given on the assumption that the sound reproducer 260 includes a plurality of loud speakers. However, the sound reproducer 260 may be a headphone. In such a case, the output unit 234 temporarily decodes the signal into a signal for the loud speakers having a predetermined configuration, and convolutes and adds a predetermined head-related transfer function (HRTF) to the signal. In this way, the output unit 234 outputs a binaural signal to the sound reproducer 260 that is a headphone.

In the embodiment described above, the description has been given on the assumption that pieces of sound data (LF, LB, RF, and RB of the A-format) acquired with the microphones 144 are recorded as the recorded sound information in association with the inclination angle data. In addition, the description has been given on the assumption that projective transformation is performed on the pieces of sound data (LF, LB, RF, and RB of the A-format) of the respective microphones 144 through a channel exchange as illustrated in FIG. 6A. However, the sound information to be recorded and a manner of projective transformation are not limited to the sound information and the manner of projective transformation of the embodiment described above.

Figure 6B:
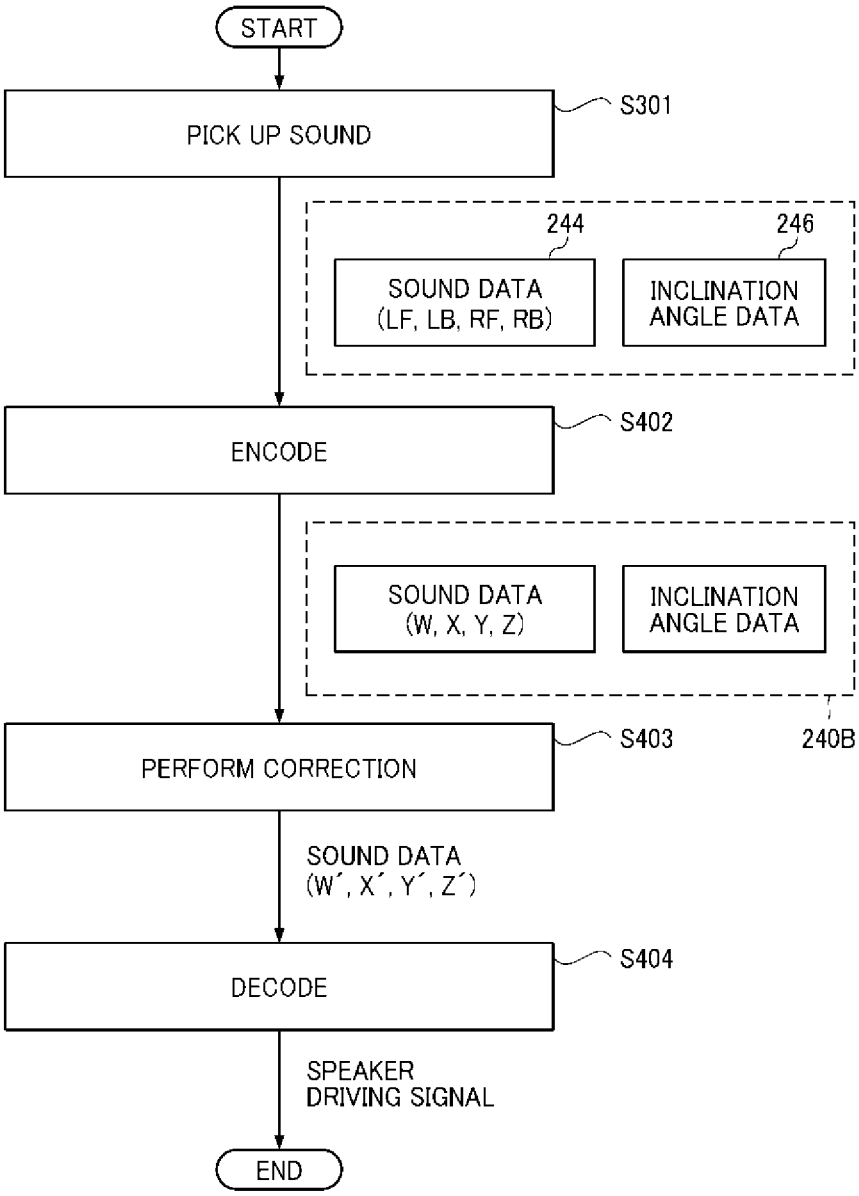
FIG. 6B is a flowchart illustrating a flow from acquisition to reproduction of sound data in an example in which Ambisonics is adopted as a stereophonic sound technique.

FIG. 6B illustrates a flow from acquisition to reproduction of sound data in other embodiment. In the other embodiment illustrated in FIG. 6B, after performing S301, the sound signal processor 218 encodes a plurality of sound signals acquired by the plurality of microphones 144, and the recorder 224 records the encoded stereophonic sound data in a file 240B (S402). In a certain embodiment in which Ambisonics is adopted as the stereophonic sound technique, this stereophonic sound data is data referred to as "B-format (W, X, Y, and Z)". This stereophonic sound data (W, X, Y, and Z) is recorded in the file 240B in association with the inclination angle data as illustrated in FIG. 6B.

In such a case, zenith correction and/or rotation correction are performed on the encoded stereophonic sound data (W, X, Y, and Z of the B-format) in the other embodiment as illustrated in FIG. 6B (S403). For example, zenith correction equivalent to a rotation on the horizontal plane by q as illustrated in FIG. 7A can be typically implemented by projective transformation represented using Equation (2).

[Math.2]

$$\begin{bmatrix} W' \\ X' \\ Y' \\ Z' \end{bmatrix} = \begin{bmatrix} 1 & 0 & 0 & 0 \\ 0 & \cos\theta & \sin\theta & 0 \\ 0 & -\sin\theta & \cos\theta & 0 \\ 0 & 0 & 0 & 1 \end{bmatrix} \begin{bmatrix} W \\ X \\ Y \\ Z \end{bmatrix} \quad \text{Equation (2)}$$

As described above, in this embodiment, a plurality of sound signals acquired by using the plurality of microphones 144 are encoded, and consequently the stereophonic sound data 244 is temporarily generated. Zenith correction or rotation correction is performed on this stereophonic sound data 244. The output unit 234 decodes the zenith-corrected or rotation-corrected stereophonic sound data (W', X', Y', and Z') and outputs a speaker driving signal according to the configuration of the sound reproducer 260 (S404).

According to the embodiments described above, inclination angle data for a predetermined time point is recorded in association with sound data for the predetermined time point. Thus, zenith correction and/or rotation correction is successfully performed on the sound data in accordance with the corresponding inclination angle. Further, the user is allowed to capture a spherical moving image and record sound while moving the spherical image capturing apparatus 110 without worrying about the state of the microphones 144 used to record stereophonic sound. In addition, when the spherical moving image is viewed, the unnaturalness of the directivity of the reproduced sound field, which results from a change in the position of the spherical image capturing apparatus 110, is successfully reduced at the time of reproduction because zenith correction and/or rotation correction is performed on the sound data in accordance with the inclination angle.

In the embodiments described above, components relating to reproduction, such as the reader 226, the parameter generator 228, the image transformer 230, and the sound transformer 232 are also included as components of the spherical image capturing apparatus 110. However, in another embodiment, the components relating to reproduction may be included in an external apparatus.

Figure 8:
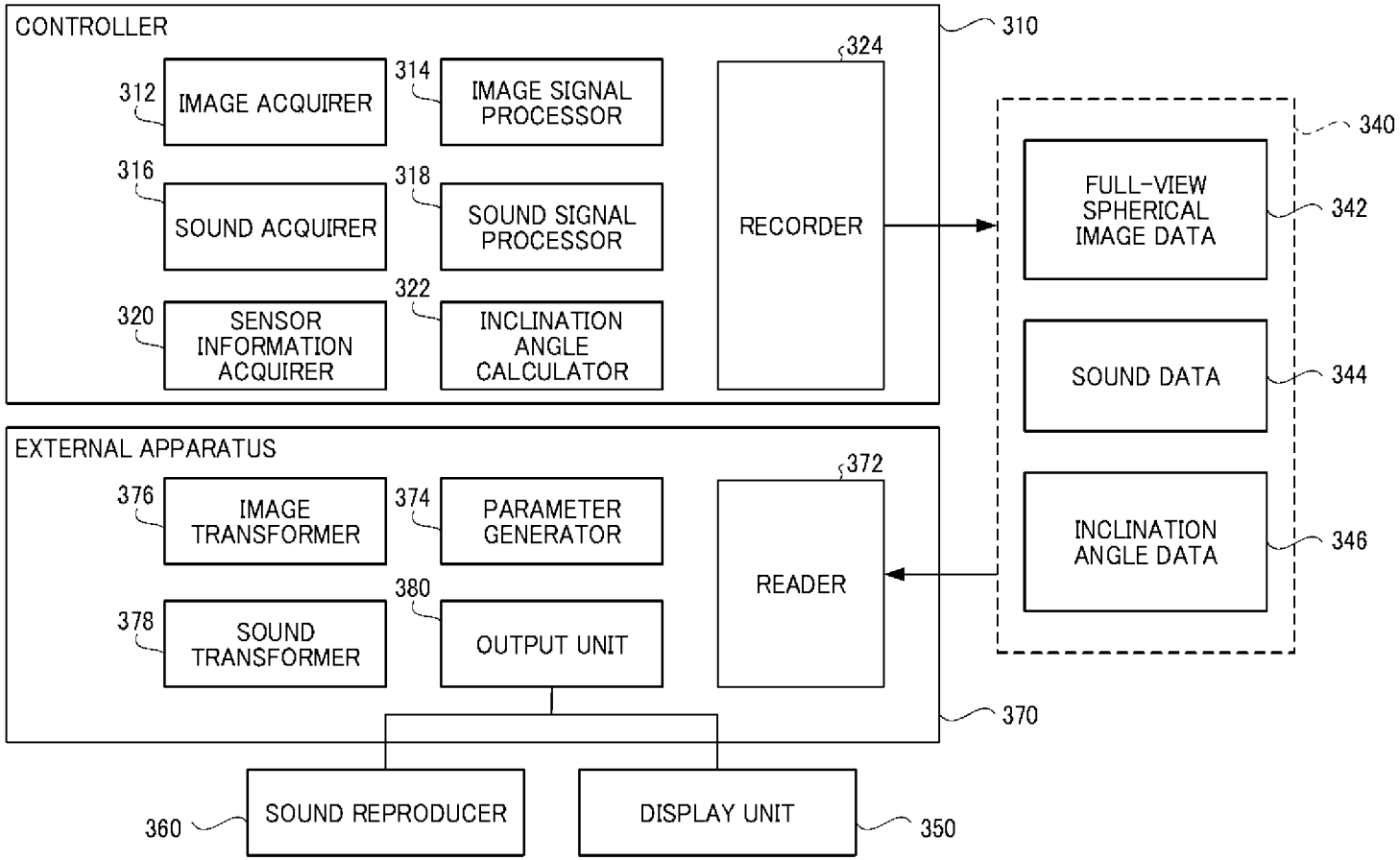
FIG. 8 is a functional block diagram relating to image-sound recording functions implemented in a spherical image capturing apparatus according to other embodiment.

FIG. 8 is a diagram illustrating functional blocks relating to image-sound recording functions implemented in a spherical image capturing apparatus according to another embodiment. In the embodiment illustrated in FIG. 8, a controller 310 of the spherical image capturing apparatus 110 includes an image acquirer 312, an image signal processor 314, a sound acquirer 316, a sound signal processor 318, a sensor information acquirer 320, an inclination angle calculator 322, and a recorder 324 as functional blocks. An external apparatus 370, which is a reproduction apparatus, includes a reader 372, a parameter generator 374, an image transformer 376, a sound transformer 378, and an output unit 380 as functional blocks. In this case, a file 340 that is stored by the recorder 324 of the spherical image capturing apparatus 110 is transmitted to the external apparatus 370 via a USB interface or a network, for example. The external apparatus 370 may be a general-purpose computer, such as a personal computer, a tablet computer, a workstation, or a server.

As a result of including the components relating to reproduction in the external apparatus 370 as illustrated in FIG. 8, a calculation load applied when stereophonic sound data is converted into a speaker driving signal can be offloaded and placed on the external apparatus 370.

The embodiments described above can provide a sound recording apparatus, a sound system, a sound recording method, a program, and a data structure that enable unnaturalness of the directivity of a reproduced sound field, which results from a change in the position of the apparatus during image capturing or recording, to be corrected.

The functional units described above can be implemented by a computer-executable program that is written in a legacy programming language or an object-oriented programming language, such as assembler, C, C++, C#, or Java (registered trademark), and that can be stored and distributed on an apparatus-readable recording medium such as a ROM, an electrically erasable programmable ROM (EEPROM), an erasable programmable ROM (EPROM), a flash memory, a flexible disk, a Compact Disc-Read Only Memory (CD- ROM), a CD-Rewritable (CD-RW), a Digital Versatile Disc-ROM (DVD-ROM), a DVD-RAM, a DVD-Rewritable (DVD-RW), Blu-ray Disc, a Secure Digital (SD) card, or a magneto-optical disk (MO). Alternatively, the computer-executable program can be distributed via an electrical communication line. In addition, some or all of the functional units described above can be implemented using a programmable device (PD) such as a field programmable gate array (FPGA), or as an application-specific integrated circuit (ASIC). The computer-executable program can be distributed as circuit configuration data (bitstream data) downloaded to the PD to implement the functional units using the PD and as data written in Hardware Description Language (HDL), Very High Speed Integrated Circuits (VHSIC) Hardware Description Language (VHDL), or Verilog-HDL to implement the circuit configuration data by using a recording medium.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The present invention can be implemented in any convenient form, for example using dedicated hardware, or a mixture of dedicated hardware and software. The present invention may be implemented as computer software implemented by one or more networked processing apparatuses. The processing apparatuses can compromise any suitably programmed apparatuses such as a general purpose computer, personal digital assistant, mobile telephone (such as a WAP or 3G-compliant phone) and so on. Since the present invention can be implemented as software, each and every aspect of the present invention thus encompasses computer software implementable on a programmable device. The computer software can be provided to the programmable device using any conventional carrier medium (carrier means). The carrier medium can compromise a transient carrier medium such as an electrical, optical, microwave, acoustic or radio frequency signal carrying the computer code. An example of such a transient medium is a TCP/IP signal carrying computer code over an IP network, such as the Internet. The carrier medium can also comprise a storage medium for storing processor readable code such as a floppy disk, hard disk, CD ROM, magnetic tape device or solid state memory device.

In one embodiment, the present invention may reside in a sound recording apparatus including circuitry to: acquire sound data generated from a plurality of sound signals collected at a plurality of microphones; acquire, from one or more sensors, a result of detecting a position of the sound recording apparatus at a time point during a time period when the plurality of sound signals is collected; and store, in a memory, position data indicating the position of the sound recording apparatus detected at the time point, and sound data generated based on a plurality of sound signals collected at the microphones at the time point at which the position was detected, in association with each other.

In one embodiment, the present invention may reside in a system including circuitry to: acquire sound data generated from a plurality of sound signals collected at a plurality of microphones; acquire, from one or more sensors, a result of detecting a position of the sound recording apparatus at a time point during a time period when the plurality of sound signals is collected; and store, in a memory, position data indicating the position of the sound recording apparatus detected at the time point, and sound data generated based on a plurality of sound signals collected at the microphones at the time point at which the position was detected, in association with each other.

In one embodiment, the present invention may reside in a non-transitory recording medium storing a plurality of instructions which, when executed by one or more processors, cause the processors to perform a sound recording method including: acquiring sound data generated from a plurality of sound signals collected at a plurality of microphones; acquiring, from one or more sensors, a result of detecting a position of a sound recording apparatus at a time point during a time period when the plurality of sound signals is collected; and storing, in a memory, position data indicating the position of the sound recording apparatus detected at the time point, and sound data generated based on a plurality of sound signals collected at the microphones at the time point at which the position was detected, in association with each other.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

This patent application is based on and claims priority pursuant to Japanese Patent Application Nos. 2017-048769, filed on Mar. 14, 2017, and 2018-030769, filed on Feb. 23, 2018, in the Japan Patent Office, the entire disclosure of which is hereby incorporated by reference herein.

REFERENCE SIGNS LIST

110 spherical image capturing apparatus
112 CPU
114 ROM
116 image processing block
118 moving image block
120 DRAM interface
122 external storage interface
124 sensor interface
126 USB interface
128 serial block
130 imaging element
131 optical system
132 DRAM
134 external storage
136 sensor
138 USB connector
140 wireless communication interface
142 ADC
144 microphone
146 operation unit
148 image capturing mode switch
150 release switch
210, 310 controller
212, 312 image acquirer
214, 314 image signal processor
216, 316 sound acquirer
218, 318 sound signal processor
220, 320 sensor information acquirer
222, 322 inclination angle calculator
224, 324 recorder
226, 372 reader
228, 374 parameter generator

230, 376 image transformer
232, 378 sound transformer
234, 380 output unit
240, 340 file
242, 342 spherical image data
244, 344 stereophonic sound data
246, 346 inclination angle data
250, 350 display unit
260, 360 sound reproducer

The invention claimed is:

1. A handheld sound recording apparatus, comprising:
control circuitry configured to
acquire sound data generated from a plurality of sound signals collected at a plurality of microphones and generate a spherical image from a plurality of images captured by a plurality of imaging elements and a plurality of image forming optical systems of a moving sound recording apparatus during a time period when the moving sound recording apparatus moves;
acquire, from one or more sensors, a result of detecting a position of the moving sound recording apparatus at a time point during the time period when the plurality of sound signals was collected;
store, in a memory, position data indicating the detected position of the moving sound recording apparatus detected at the time point in association with the acquired sound data generated based on the plurality of sound signals collected at the plurality of microphones during the time period that includes the time point at which the position was detected; and
generate a projective transformation parameter based on the detected position of the moving sound recording apparatus that was detected at the time point when the plurality of sound signals was collected,
wherein the control circuitry is further configured to perform zenith correction on both the acquired sound data to generate corrected sound data and the spherical image to generate corrected spherical image, using the projective transformation parameter generated based on the detected position of the moving sound recording apparatus that was detected at the time point when the plurality of sound signals was collected, independent of a viewpoint of a user during playback of the acquired sound data.

2. The sound recording apparatus of claim 1,
wherein the sound data acquired by the control circuitry includes a plurality of items of sound data generated respectively from the plurality of sound signals collected at the plurality of microphones, or stereophonic sound data encoded from the plurality of sound signals collected at the plurality of microphones.

3. The sound recording apparatus of claim 1, further comprising:
at least one image capturing optical system configured to capture images,
wherein the control circuitry is further configured to store image data generated based on one or more images captured during the time period that includes the time point at which the position was detected, in association with the position data and the sound data, each corresponding to the time point at which the position was detected.

4. The sound recording apparatus of claim 3,
wherein the control circuitry is further configured to perform a projective transformation on the image data, using the detected position of the moving sound recording apparatus detected at the time point.

5. The sound recording apparatus of claim 4, further comprising:
an operation interface configured to receive a selection indicating whether to perform at least one of the zenith correction and rotation correction,
wherein the control circuitry is further configured to perform the zenith correction when the selection indicates to perform the zenith correction.

6. The sound recording apparatus of claim 3, wherein the time point at which the position was detected is any point of time during when a unit group of frames of the images is being captured by the at least one image capturing optical system.

7. The sound recording apparatus of claim 3, wherein the image capturing optical system includes at least one optical system provided with a wide-angle lens.

8. The sound recording apparatus of claim 1,
wherein the control circuitry is further configured to store the detected position data, which includes one of: an inclination angle of the moving sound recording apparatus relative to a reference direction, and a set of the inclination angle of the moving sound recording apparatus and a rotation angle of a horizontal face with respect to a predetermined front direction, each calculated based on the result of detecting the position.

9. A sound system, comprising:
the sound recording apparatus of claim 1; and
a sound reproducing apparatus,
wherein the control circuitry of the moving sound recording apparatus is further configured to encode the acquired sound data to generate encoded stereophonic sound data, and decode the encoded stereophonic sound data according to a specification of the sound reproducing apparatus to generate a speaker driving signal for output to the sound reproducing apparatus.

10. The sound system of claim 9, further comprising:
a display configured to display one or more images based on image data stored in the memory in association with the acquired sound data and the position data.

11. The sound system of claim 9, wherein the control circuitry is further configured to perform rotation correction on the acquired sound data.

12. The sound recording apparatus of claim 1, wherein the control circuitry is further configured to perform the zenith correction on the acquired sound data when the position of the moving sound recording apparatus at the time point is horizontal.

13. The sound recording apparatus of claim 1, wherein the control circuitry is further configured to perform rotation correction on the acquired sound data.

14. The sound recording apparatus of claim 1, wherein the control circuitry is further configured to:
calculate an inclination angle and a rotation angle of a horizontal face to a predetermined front direction of the moving sound recording apparatus at the time of recording based on the detected position of the moving sound recording apparatus, and
generate the projection transformation parameter based on the inclination angle and the rotation angle of the horizontal face to the predetermined front direction of the moving sound recording apparatus.

15. A sound recording method, performed by a handheld sound recording apparatus, the method comprising:
acquiring sound data generated from a plurality of sound signals collected at a plurality of microphones and generating a spherical image from a plurality of images captured by a plurality of imaging elements and a plurality of image forming optical systems of a moving sound recording apparatus during a time period when the moving sound recording apparatus moves;

acquiring, from one or more sensors, a result of detecting a position of the moving sound recording apparatus a time point during the time period when the plurality of sound signals is collected;

storing, in a memory, position data indicating the detected position of the moving sound recording apparatus detected at the time point in association with the acquired sound data generated based on the plurality of sound signals collected at the plurality of microphones during the time period that includes the time point at which the position was detected; and generating a projective transformation parameter based on the detected position of the moving sound recording apparatus that was detected at the time point when the plurality of sound signals was collected, wherein the method further comprises performing zenith correction on both the acquired sound data to generate corrected sound data and the spherical image to generate corrected spherical image, using the projective transformation parameter generated based on the detected position of the moving sound recording apparatus that was detected at the time point when the plurality of sound signals was collected, independent of a viewpoint of a user during playback of the acquired sound data.

16. The sound recording method of claim 15, wherein the storing step includes one of:

storing, as the acquired sound data, a plurality of items of sound data generated respectively from the plurality of sound signals collected at the plurality of microphones; and storing, as the acquired sound data, stereophonic sound data encoded from the plurality of sound signals collected at the plurality of microphones.

17. The sound recording method of claim 15, further comprising:

capturing images with at least one image capturing optical system; and storing image data generated based on one or more images captured during the time period that includes the time point at which the position was detected, in association with the position data and the sound data, each corresponding to the time point at which the position was detected.

18. A non-transitory computer-readable medium storing computer readable code for controlling a computer to carry out the method of claim 11.

19. The computer-readable medium of claim 18, wherein the method further comprises performing rotation correction on the acquired sound data.

20. The sound recording apparatus of claim 15, wherein the method further comprises performing rotation correction on the acquired sound data.

* * * * *